United States Patent [19]

Grassel et al.

[11] Patent Number: 4,839,202

[45] Date of Patent: Jun. 13, 1989

[54] METHOD AND APPARATUS FOR COATING A MOVING SUBSTRATE

[75] Inventors: William H. Grassel; Doak Borst, both of Delmont, Pa.

[73] Assignee: Aluminum Company of America, Pittsburgh, Pa.

[21] Appl. No.: 161,250

[22] Filed: Feb. 19, 1988

Related U.S. Application Data

[63] Continuation of Ser. No. 912,422, Sep. 29, 1986, abandoned.

[51] Int. Cl.[4] ..... B05D 1/02

[52] U.S. Cl. ..... 427/424; 118/674; 118/695; 118/708; 118/325

[58] Field of Search ..... 427/424; 118/325, 708, 118/674, 695

[56] References Cited

U.S. PATENT DOCUMENTS

| | | | |
|---|---|---|---|
| 2,754,227 | 7/1956 | Ransburg | 117/93 |
| 2,770,210 | 11/1956 | Miller | 118/674 |
| 2,994,618 | 8/1961 | Landgraf | 117/93 |
| 3,402,695 | 9/1968 | Baker et al. | 118/674 |
| 3,726,701 | 4/1973 | Nishikawa et al. | 117/17 |
| 4,132,189 | 1/1979 | Greve et al. | 118/325 X |
| 4,431,690 | 2/1984 | Matt et al. | 118/674 X |

FOREIGN PATENT DOCUMENTS

| | | | |
|---|---|---|---|
| 500845 | 4/1976 | U.S.S.R. | 118/674 |

*Primary Examiner*—Shrive Beck
*Attorney, Agent, or Firm*—David W. Brownlee

[57] ABSTRACT

Apparatus and process for applying a coating of material to a moving substrate. Use of apparatus of this invention enables varying the quantity of liquid material supplied to an atomizing nozzle proportionately with any variance in speed of the substrate moving through the apparatus. A uniform thickness or weight of coating for a unit area of substrate is maintained regardless of the speed of movement of the substrate.

7 Claims, 2 Drawing Sheets

METHOD AND APPARATUS FOR COATING A MOVING SUBSTRATE

This application is a continuation, of application Ser. No. 912,422, filed Sept. 29, 1986, now abandoned.

BACKGROUND OF THE INVENTION

This invention relates to spray coating a moving substrate. More particularly, it relates to providing a uniform thickness or quantity of atomized particles on a substrate that may be moving at varying speeds.

Applying coatings such as oils and waxes by directly spraying or by electrostatic deposition on a continuously unwinding strip from a coil is well known. Electrostatic deposition of such sprayed materials has become increasingly popular because it provides efficient use in applying uniform thicknesses of coating materials. Whether a material is applied by direct spraying or electrostatic deposition, however, it has been a problem to apply a uniform thickness of coating to a substrate moving at varying speeds. Thus, during start-up or shutdown of a coating line, for example, the quantity of material delivered to a unit area of sheet would vary unless changes were also made in control of atomizing and/or spraying the material.

A number of proposals have been made to synchronize changes in control of the rate of deposition of material with changes in the speed of the substrate. For example, Landgraf U.S. Pat. No. 2,994,618 proposes that the velocity of a secondary air supply which carries atomized material into the deposition chamber be varied as the speed of the moving substrate varies. Nishikawa et al U.S. Pat. No. 3,726,701 controls both the air flow carrying the atomized particles and the potential in the electrostatic charging zone as the speed of movement of the substrate varies to control the uniformity of deposition of material.

An additional problem has been to apply very thin coatings of materials uniformly to a moving substrate. It is evident that the thinner the desired coating, the greater the percentage of difference in coating thickness with any variation at all in delivery of material to the substrate. The severity of the problem and the importance of finding a solution can be illustrated with reference to just one example. Aluminum sheet manufacturers supply millions of pounds of coiled sheet each year to the can industry for making can bodies and can ends. The sheet for making can ends is coated with a thin layer of Dioctyl Sebecate (DOS), a synthetic lubricant, which is applied to prevent the generation of surface defects during shipping and handling. A substantial portion of the can end material is coated on both sides or one side by the can maker with an organic coating before being formed into can ends. The organic coating is applied to serve as a barrier between the metal and a food or beverage product in the can. The organic coating is applied over the DOS layer, but if the DOS layer is too thick, the organic coating will not adhere properly to the sheet. For this reason, can manufacturers specify that there be no more DOS material on the sheet than that which is absolutely necessary to protect the surface finish. Typically, it is applied at a nominal weight of 1.0 mg/ft$^2$. As an indication of how thin a coating of DOS of that weight is, it would take only 55.4 ml to cover an area the size of a football field with such a coating weight. It is apparent that the difficulty of uniformly applying such a thin coating is compounded when the speed of the substrate increases in starting up a coil or slows down near the end of the coil. Consistent and uniform application of thin coatings of DOS lubricant to can end stock has been a major problem for metal manufacturers because of the large quantities of metal used in this application.

Thus, it may be seen that it is desirable to compensate for changes in speed of a moving substrate in the application of an atomized sprayed coating of materials thereon.

SUMMARY OF THE INVENTION

A method and apparatus of this invention enables the application of a uniform coating of atomized material to a moving substrate moving at a nonuniform rate of speed. In the practice of the invention, the material to be applied to the substrate is pumped from a tank or reservoir by a metering pump and fed to an atomizer or spray nozzle. As an alternative, the material to be applied to the substrate might be carried in a pressurized line with its feed to the nozzle controlled by a flow control valve. The output of the metering pump or the flow control valve is varied in response to changes in speed of the moving substrate so that as the speed of the substrate varies, the quantity of material being fed to the nozzle varies as well. Thus, a coating of atomized material can be uniformly applied to the substrate even though it may be moving at varying speeds. A relatively high velocity air stream carries finely atomized particles from the nozzle through a fog box which spreads the cloud of particles into a relatively narrow band as wide as the substrate. From the fog box, the reshaped cloud of particles is transported into the deposition chamber where the particles are electrically charged and deposited on the substrate moving through the chamber.

It is an objective of this invention to enable a uniform application of atomized materials to a moving substrate even though the substrate may be moving at varying speeds.

It is also an objective of this invention to provide a method and apparatus to apply very thin coatings of materials to a moving substrate.

These and other objectives and advantages of the invention will be more readily apparent with reference to the following description of a preferred embodiment of the invention and the related drawing.

DESCRIPTION OF A PREFERRED EMBODIMENT

Figure 1:
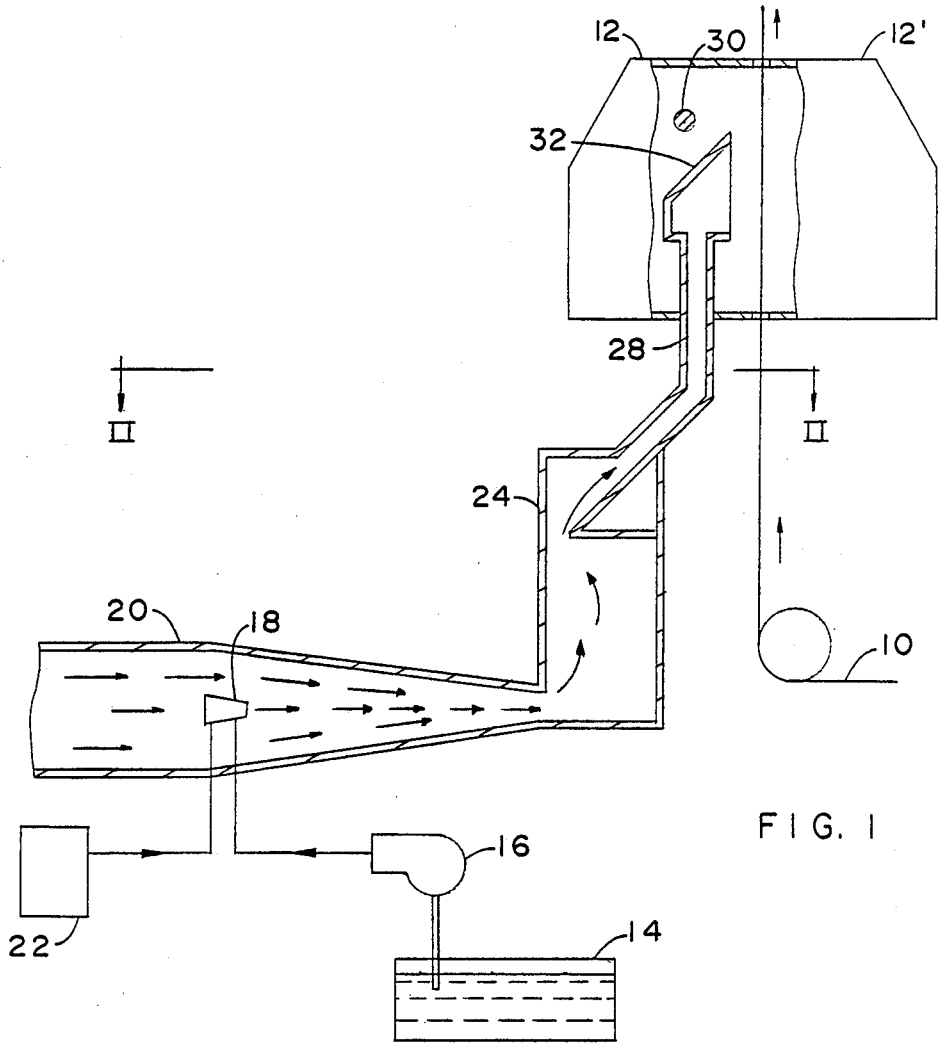
FIG. 1 is a cross-sectional view of apparatus of this invention with a moving substrate to be coated passing therethrough.
Figure 2:
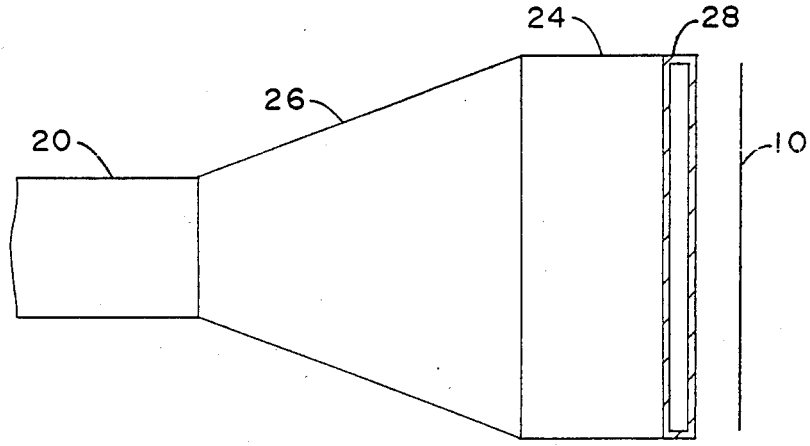
FIG. 2 is a plan view of the fog box portion of the apparatus shown in FIG. 1.

Since this invention is particularly beneficial in applying very thin coatings of material to a moving substrate, a preferred embodiment will be described with reference to coating coiled aluminum sheet with Dioctyl Sebecate (DOS) lubricant. It is to be understood, however, that this invention is not limited to this described use, nor to an electrostatic method of application. A process of this invention is also suitable and useful for controlling the uniformity of a coating sprayed directly on a moving substrate.

Referring now to the Figures, to protect the surface finish on a coil of metal 10, it is passed through a deposition chamber 12 where it receives a coating of DOS atomized oil.

The oil to be atomized is held in a reservoir or tank 14 and is transported by a metering pump 16 to an atomizing nozzle 18 which is mounted in an enclosed elongated housing 20. Air for atomizing the oil is supplied from a constant pressure air supply 22 and is supplied at a relatively high pressure to form small particles. The particular pressure will depend on the type of nozzle being used and the type of material to be atomized. What is important is that the material be atomized into very fine particles. A transport air source (not shown) supplies a stream of secondary air into the housing 20 at a relatively high constant velocity. The particular velocity of secondary air like the pressure of the atomizing air is subject to a number of variables, such as the type of material to be transported, the size of the ducts through which the atomized particles are transported and the distance that they must travel. For purposes of this invention, the velocity is that which advances the atomized particles quickly to the deposition chamber, and it is noted that the velocity remains constant regardless of changes in speed of the substrate or volume of material delivered to the nozzle to be atomized. This stream of moving air transports the atomized DOS particles in the direction of the arrows into a fog box 24. Note that in this preferred embodiment only one nozzle 18 is used to atomize the DOS lubricant. The reason is that thin coating applications require small flow rates or small volumes of material at typical production line speeds and only one nozzle can practically be used to atomize such small volumes. Using only one nozzle, however, creates a problem because the output from just this single nozzle must be distributed across a sheet 10 which is typically 54 inches wide. In order to distribute the cloud of atomized particles issuing from the nozzle 18 across the full width of the sheet 10, the cloud is charged through the transition 26 and fog box 24 before entering the deposition chamber 12. Note that the fog box 24 has substantially the same width as the sheet 10. To widen the cloud of particles issuing from the nozzle 18, the passageway 26 leading from the nozzle housing 20 to the fog box 24 tapers outwardly in width and inwardly in height. Thus, the cross-sectional area of the passageway 26 is substantially the same at any point as the cross-sectional area of the nozzle housing 20 and the velocity of the air stream is constant. As the cloud of particles enters the box, its velocity slows and the cloud of particles rises toward the chimney or outlet 28. During its rise, larger, oversize particles in the cloud fall by gravity to the bottom of the box or contact and adhere to the box sides. The secondary air stream then carries the particles which are now substantially uniform in size through the chimney 28 into the deposition chamber 12. The chimney 28 has substantially the same cross-sectional area as the nozzle housing 20 to maintain a constant velocity of the particle cloud being charged into the deposition chamber 12. An ionizing wire 30 or other electrostatic charging means is provided in the chamber 12 to charge the atomized particles which are then attracted to the sheet 10 by electrostatic forces. To assist in depositing the particles on the sheet 10, a deflector 32 attached to the outlet end of the chimney 28 directs the cloud of particles carried by the air stream towards the sheet.

Figure 3:
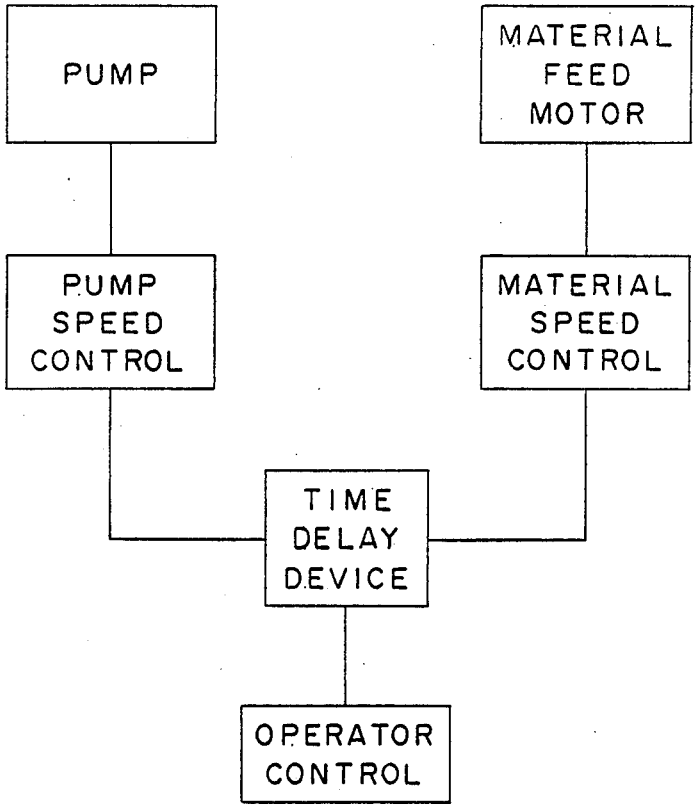
FIG. 3 is a schematic diagram of the control system employed to operate apparatus of this invention.

As noted earlier, one of the functions of the fog box 24 is to widen the stream of particles issuing from a single nozzle to the width of the sheet to be covered. If another material, such as a wax, for example, is to be applied in a heavier thickness, nozzles are added as needed to atomize the additional volumes of the material into very fine particles. To minimize the potential for agglomeration of the very fine particles, each nozzle is provided with its own enclosed passage to the fog box. It is apparent that as the number of nozzles increases, the less is the need to widen the stream of particles issuing from each nozzle, and the cross sections of the nozzle housing 20, passageway 26 from the housing 12 to the fog box 24, and the fog box 24 are altered accordingly. Although the fog box 24 may not be essential to the invention in applying thicker coatings of some materials, it enables oversize or heavy particles to separate by gravity and thereby provides a mist of particles having a nearly uniform size to the deposition enclosure 12. Varying the quantity of oil fed to the atomizer nozzle 18 as the speed of the sheet 10 is varied is accomplished with an operator control system shown schematically in FIG. 3. It may be seen that any change in speed of the motor driving the coil instantaneously affects the speed of the sheet passing through the deposition enclosure. A change in the volume of oil to the nozzle, however, does not create an instantaneous change in the mist in the deposition enclosure. The control system is provided to compensate for the time required to change the quantity of particles delivered to the deposition chamber. When the need arises to change the speed of the sheet 10 passing through the deposition chamber 12, the speed change is initiated by actuating the operator control. The signal from the operator control passes through a time delay device which first changes the speed of the pump through the pump speed control. As the pump delivers a lesser or greater amount of oil to the nozzle, a lesser or greater amount of atomized particles is transported to the deposition chamber 12. Commensurate with the length of time required for transport of the altered quantity of atomized particles to reach the deposition chamber 12, the time delay device initiates a signal to the material speed control to decrease or increase the speed of the motor driving the sheet.

In this preferred embodiment, the oil is transported to the nozzle 18 with a pump 16. A flow control valve could be substituted for the pump. If the oil was under pressure in a line, for example, a flow control valve in the line could be linked to the time delay device rather than the pump speed control shown in FIG. 3. This preferred embodiment has been described with respect to coating only one side of the strip 10. It is apparent that an additional deposition chamber 12 can be added to apply material to the opposite side of the strip material.

While the invention has been described in terms of preferred embodiments, the claims appended hereto are intended to encompass all embodiments which fall within the spirit of the invention.

What is claimed is:

1. A method of coating a surface of a moving substrate, comprising:

providing a nozzle for atomizing a liquid to be applied to a moving substrate;

providing means for supplying the liquid to the nozzle;

providing means for moving the substrate;

providing control means for changing the rate of supply of liquid to the nozzle and changing the speed of the moving substrate;

providing a time delay means in connection with the control means to change the speed of the substrate at a predetermined time after changing the rate of supply of liquid to the nozzle; and actuating the control means whereby a change in the rate of supply of liquid to the nozzle is first made and a change in speed of the substrate is made at a predetermined time thereafter.

2. Apparatus for applying a coating on a moving substrate, comprising:

a nozzle;

means for supplying a liquid to the nozzle;

means for moving a substrate to be coated;

control means for controlling the speed of the substrate and changing the rate of supply of liquid to the nozzle proportionate to a change in the speed of the substrate; and a time delay means connected to the control means for sequentially changing the speed of the substrate at a predetermined time interval after changing the rate of supply of liquid.

3. A method for electrostatically applying a very thin and uniform liquid coating to a moving substrate comprising:

pumping liquid coating material to a nozzle to atomize the liquid;

supplying atomizing air to the nozzle at a substantially constant and relatively high pressure to form a relative fine mist of the atomized liquid;

moving a substrate to be coated through a deposition chamber;

transporting the mist from the nozzle to the deposition chamber in a stream of air at a substantially constant velocity for application to the moving substrate in a relatively thin uniform coating;

controlling the amount of coating applied to the substrate by controlling the amount of liquid forced through the nozzle and the speed of the substrate through the chamber; and varying the amount of liquid forced through the nozzle, without changing the pressure of the air supplied to the atomizing nozzle, to vary the amount of coating material supplied to the deposition chamber.

4. A method as set forth in claim 3 in which the volume of liquid supplied to the nozzle is varied in proportion to the change in speed of the substrate to maintain the application of a relatively thin uniform thickness.

5. A method as set forth in claim 3 in which a metering pump is used to force the liquid coating material through the nozzle, and the speed of the pump is varied to vary the amount of liquid so forced.

6. A method as set forth in claim 3 in which a control valve is used to vary the amount of liquid forced through the nozzle.

7. Apparatus for applying a very thin and uniform a coating on a moving substrate comprising:

a nozzle;

a pump for supplying a liquid to said nozzle for atomization of the liquid, said pump being controllable to meter the amount of liquid that it supplies to the nozzle;

means for supplying substantially constant, relative high pressure air to the nozzle to form a fine mist of the atomized liquid;

an electrostatic deposition chamber;

means for transporting the fine mist of atomized liquid to said deposition chamber;

means for moving a substrate to be coated through the deposition chamber;

means for controlling said pump and the speed of the moving substrate to thereby control the amount of coating applied to the substrate; and means for varying the speed of the pump to control the amount of liquid supplied to said deposition chamber.

* * * * *